US005992561A

United States Patent [19]

Holben et al.

[11] Patent Number: 5,992,561

[45] Date of Patent: Nov. 30, 1999

[54] SOUND ABSORBER, ROOM AND METHOD OF MAKING

[75] Inventors: Larry B. Holben, Dublin; Daniel M. Beam, Marysville, both of Ohio

[73] Assignee: Kinetics Noise Control, Dublin, Ohio

[21] Appl. No.: 09/003,433

[22] Filed: Jan. 6, 1998

[51] Int. Cl.[6] ..... E04B 1/82

[52] U.S. Cl. ..... 181/295; 181/30

[58] Field of Search ..... 181/30, 295, 286, 181/288, 290, 294

[56] References Cited

U.S. PATENT DOCUMENTS

| | | | |
|---|---|---|---|
| 3,382,947 | 5/1968 | Biggs | 181/30 |
| 3,857,459 | 12/1974 | Adams et al. . | |
| 4,219,101 | 8/1980 | Valsvik . | |
| 4,362,222 | 12/1982 | Hellström . | |
| 4,548,292 | 10/1985 | Noxon | 181/295 |
| 4,682,670 | 7/1987 | Lerner et al. | 181/295 |
| 4,750,586 | 6/1988 | Lerner et al. . | |
| 4,883,513 | 11/1989 | Monson et al. . | |
| 4,972,633 | 11/1990 | Wright . | |
| 5,035,298 | 7/1991 | Noxon | 181/295 |
| 5,125,475 | 6/1992 | Ducharme et al. . | |
| 5,403,979 | 4/1995 | Rogers et al. . | |
| 5,623,130 | 4/1997 | Noxon | 181/30 |

*Primary Examiner*—Khanh Dang
*Attorney, Agent, or Firm*—Christen M. Millard; Kremblas, Foster, Millard & Pollick

[57] ABSTRACT

A sound absorber is made primarily out of a triangular fiberglass panel. The front face of the sound absorber is covered with porous material. The side edges of the panel rest against walls in a room. A fiberglass pad may be attached to the back face of the panel.

24 Claims, 11 Drawing Sheets

SOUND ABSORBER, ROOM AND METHOD OF MAKING

BACKGROUND OF THE INVENTION

1. Field of the Invention

The present invention relates to a sound absorber, and more particularly to a sound absorber which is adapted to hang in the corner of a room.

2. Description of the Related Art

Sound absorbers of a variety of types have been used in the past to absorb undesirable sounds either from inside the room or outside the room. The patent to Ducharme et al., U.S. Pat. No. 5,125,475, shows an example of a standard acoustical panel currently in use.

The patents to Adams et al., U.S. Pat. No. 3,857,459; Lerner et al., U.S. Pat. No. 4,750,586; Rodgers et al., U.S. Pat. No. 5,403,979; and Valsvik, U.S. Pat. No. 4,219,101 all show ways of absorbing sound or retaining it in a certain area. These work for a variety of types of areas.

The patent to Noxon, U.S. Pat. No. 5,035,298, discloses a part of a barrel which is installed in a corner of a room for reducing low frequency waves. However, this patent is directed primarily to the method of attaching the variety of panels together. The patent to Hellstrom, U.S. Pat. No. 4,362,222, also shows a system for damping low frequencies in the corner between the ceiling and a wall of a room and focuses as well on the method of attaching the panel to the ceiling and wall in order to have greater flexibility in the use of a room.

The patent to Wright, U.S. Pat. No. 4,972,633, shows a corner mounted shield not in the area of acoustical panels.

The primary problems with these inventions is the difficulty of attaching the panel to the wall and requirement for a great deal of installation hardware. What is desirable, therefore, is a panel which can easily be installed into the corner of a room in order to reduce the low frequency wave energy. The present invention is of particular use in a recording studio, sound listening room or the like where it is particularly desirable to eliminate low frequency wavelengths which are the most difficult to eliminate. It is known that low frequency wavelengths tend to propagate more easily in the corners of a room. Thus, it is desirable to place sound absorbers in the corners in order to improve the quality of the sound that is heard or recorded. Accordingly, a new sound absorber design, the sound absorber in a room and the method of making the sound absorber have been developed in order to alleviate the problem.

SUMMARY OF THE INVENTION

The sound absorber includes a triangular panel formed of fiberglass. The triangular panel has a front face, a back face, a top edge and two side edges converging at a bottom point. The front face is covered by a porous material. At least one of the edges, and as many as all the edges may include a bevel. The porous material may be a woven polyester fabric. The edges may be hardened with a self-curing edge hardener. The fiberglass in the panel has a density of less than 15 pounds per cubic foot. The density is most preferably between 4 and 8 pounds per cubic foot and is most preferably about 6 pounds per cubic foot. At least one bracket is attached to the back face. The bracket is attached to a wire. A hook is attached to a wall and is capable of receiving the wire attached to the panel. The sound absorber may further comprise a fiberglass pad also wrapped in polyester and attached to the back face of the panel. The fiberglass pad has a flat side and a curved side and the flat side is attached to the panel. The fiberglass pad has a density preferably between 1 and 3 pounds per cubic foot and is preferably trapezoidal so as to fit neatly against the back face of the panel. The sound absorber is made by providing a panel, hardening the edges with an edge hardener, curing the edge hardener and attaching the fabric, bracket and wire mentioned above. A bracket is attached to the back face of panel and the hardener may also be applied around the bracket.

This design is useful for providing sufficient space between the panel and the corner of the room in order to successfully absorb a large number of frequencies. The absorption is most particularly found with respect to low frequency sounds which are notoriously the most difficult to absorb because of the need for proper placement of the absorber. Accordingly, the present invention solves the currently existing problems in the art.

Figure 1:
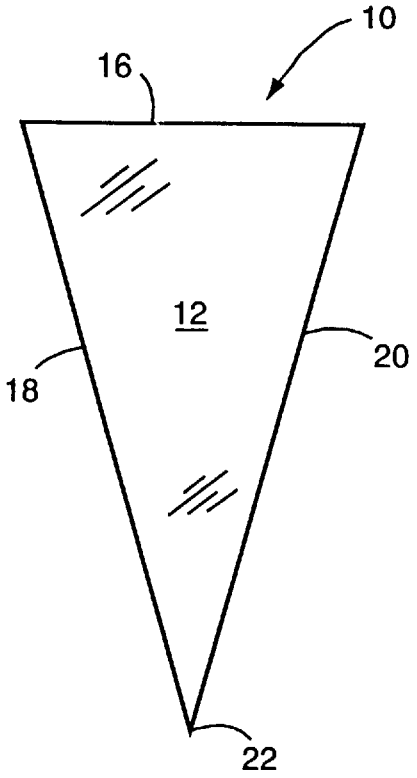
FIG. 1 is a front view of the triangular panel formed of fiberglass in accordance with the invention.
Figure 2:
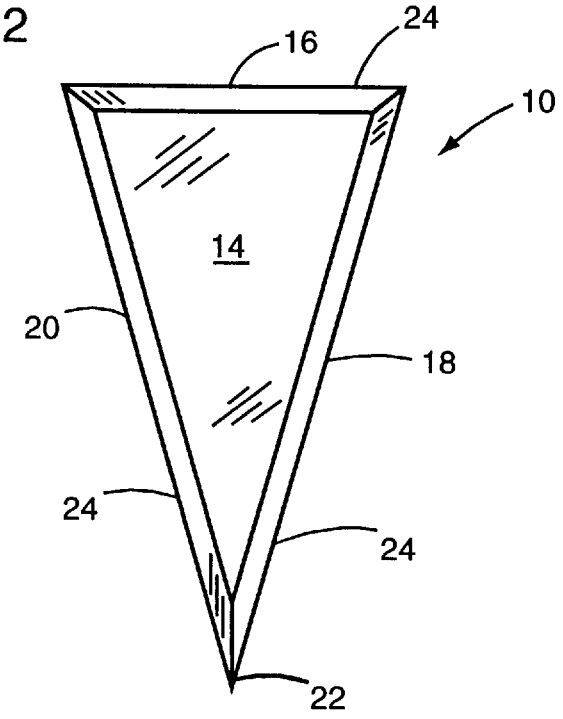
FIG. 2 is a back view of the triangular panel formed of fiberglass in accordance with the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are of ten used. They are not limited to direct connection but include connection through other elements where such connection is recognized as being equivalent by those skilled in the art.

DETAILED DESCRIPTION OF THE DRAWINGS

The process for making the sound absorber according to the invention is shown in FIGS. 1–7. There is first provided a triangular panel 10 which has a front face 12, a back face 14, a top edge 16 and two side edges 18,20 which converge to a bottom point 22. As shown most clearly in FIG. 2, at least one edge 16,18,20 includes a bevel 24 and each edge 16,18,20 may include a bevel 24 for reasons that will become apparent.

The fiberglass making up the panel of generally triangular shape 10 must have a density less than about 15 pounds per cubic foot in order to properly absorb the sound generated. Preferably the fiberglass has a density between about 4 pounds per cubic foot and about 8 per cubic foot and most preferably the fiberglass has a density of about 6 pounds per cubic foot. The edges 16,18,20 are preferably beveled at about 45 degrees.

Figure 3:
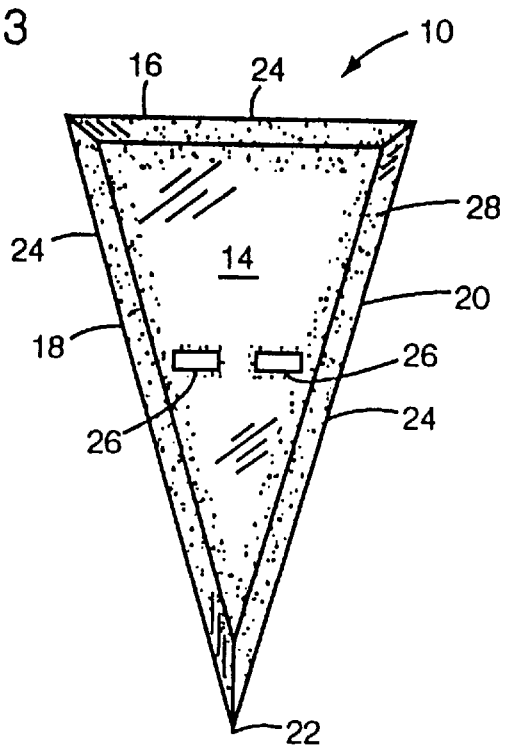
FIG. 3 is a back view of the sound absorber partially assembled.
Figure 4:
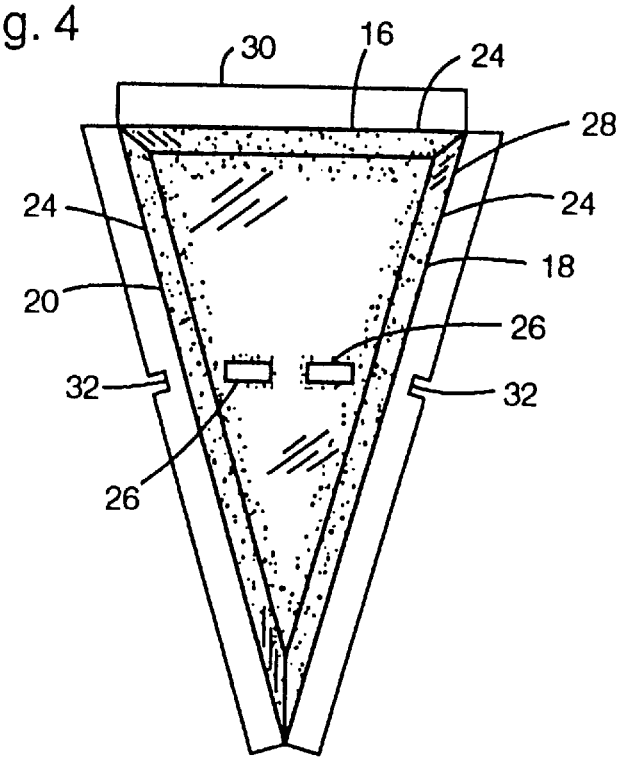
FIG. 4 is a back view of the sound absorber partially assembled.

Turning now to FIG. 3, at least one bracket 26 and preferably two brackets 26 are pressed into the back face 14 of the triangular panel 10. An edge hardener 28 is applied to each edge 16,18,20 of the fiberglass panel of generally triangular shape 10. The edge hardener 28 should be applied such that it coats each bevel 24. It is preferable that the edge hardener 28 also be applied around and through each bracket 26 to improve the attachment of the bracket 26 to the back face 14. The edge hardener 28 is then cured. The edge hardener 28 is preferably self-curing. However, it may also be heat-cured. The edge hardener 28 is most preferably that sold under the designation of FW 640 available from Franklin International.

A sheet of porous material 30 is then stretched across front face 12 and is attached to the triangular fiberglass panel 10. The material 30 must be porous to allow sound to penetrate fiberglass panel 10. The porous material 30 may extend beyond edges 16, 18, 20 and may be attached in any of a number of conventional ways including with an adhesive. If the porous material 30 extends onto edges 16,18,20, the bevel 24 and the back face 14, notches 32 should be cut into the porous material 30 such that the porous material 30 does not cover any part of the bracket 26. It is also noted that the edge hardener 28 may be used as an adhesive to attach the porous material 30 to the front face 12. The porous material 30 is preferably a fabric for, among other things, aesthetic reasons. It is preferable that the porous material 30 is a woven polyester as it will allow for sufficient sound to penetrate the porous material 30. The porous material 30 is most preferably a polyester fabric sold under the designation FR 701 by Guilford of Maine.

Figure 5:
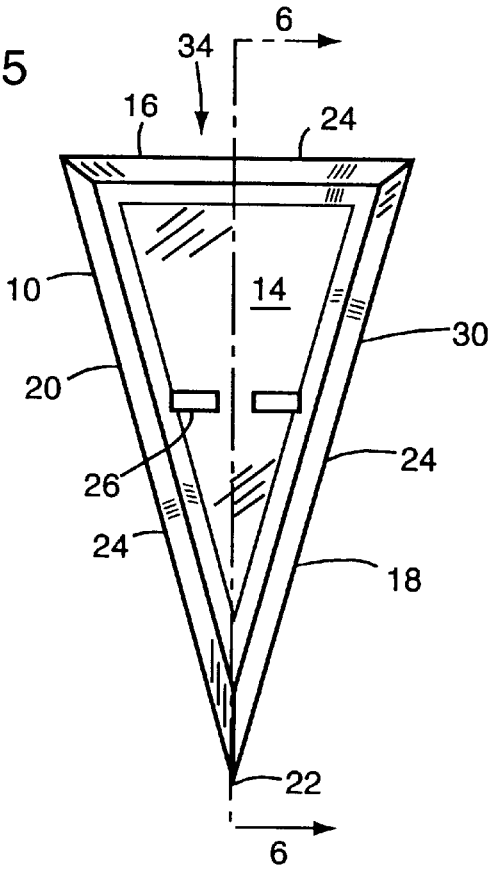
FIG. 5 is a back view of the fully assembled sound absorber.
Figure 6:
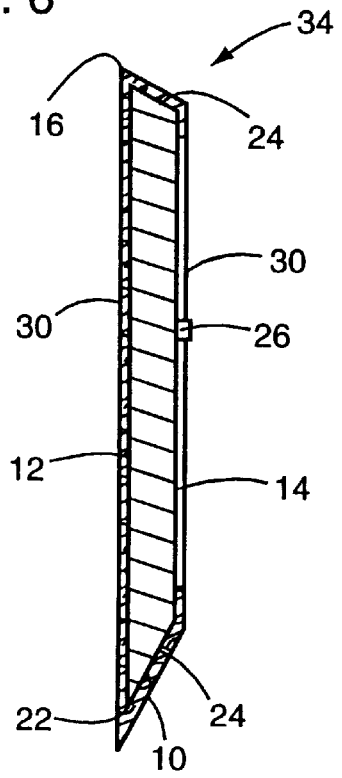
FIG. 6 is a cross-sectional view of the sound absorber according to the invention taken along line 6—6 of FIG. 5.

FIGS. 5 and 6 show the completed sound absorber 34. The sound absorber 34 includes the triangular panel 10 which has a front face 12, a back face 14, a top edge 16 and two side edges 18,20 converging at bottom point 22. Each edge 16,18,20 has a bevel 24. At least one bracket 26 is attached to the back face 14 of the sound absorber 34. The front face 12 is covered by a porous material 30 which may also extend past each edge 16,18,20 and the bevels 24 to the back face 14.

Figure 7:
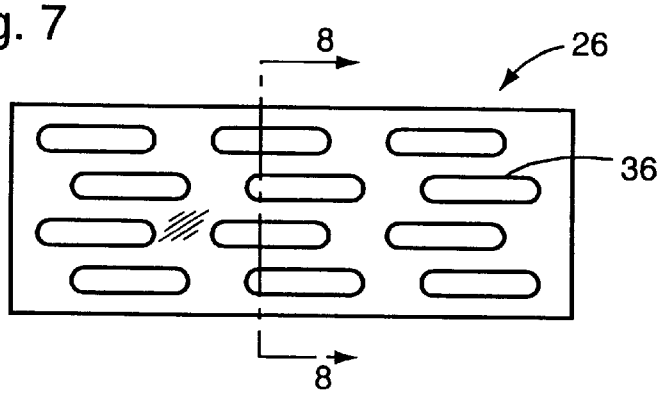
FIG. 7 is a front view of the bracket according to the invention.
Figure 8:
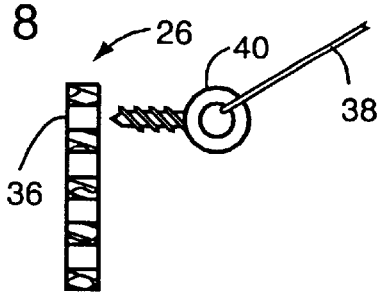
FIG. 8 is a cross-sectional view of the bracket according to the invention taken along line 8—8 of FIG. 7 and also including a screw.

The bracket 26 which is attached to the back face 14 may be of any of the standard brackets known in the art and may be a variety of items such as eye hooks, plates, springs and the like. However, it is most preferable that the bracket 26 be a gang nail or truss plate as shown in FIGS. 7 and 8. The gang nail 26 includes holes 36. The reason for the holes 36 is shown in FIG. 8. In order to attach the sound absorber 34 to any other object, a wire 38 must be attached to the sound absorber 34. Wire 38 may be any number of types of fibers such as fishing wire, metal wire, string, rope or the like as long as it is sufficiently strong to support the weight of panel 10. Preferably the wire 38 is attached to an eye screw 40 which is then screwed into the bracket 26 through one of the holes 36. It will be obvious to one of ordinary skill in the art that the wire or string 38 may be directly attached by tying the wire 38 to the bracket 26 prior to attaching the bracket 26 to the back face 14. In addition, any number of other methods may be used to attach the wire 38 to the bracket 26. However, the eye screw 40 is the most preferable. This process may be done on each bracket 26 such that the wire 38 is attached to both brackets 26.

As is apparent to one of ordinary skill in the art, the steps of making the sound absorber 34 as described earlier can be applied to any like kind of sound absorber. Thus, the further drawings of the sound absorber in its various embodiments will not show the detail of the sound absorber as shown in FIGS. 1–8. However, it will be understood that each embodiment of the sound absorber 34 will have the same features as that described above. This will include the edge hardener 28, the fabric covering 30 and the like even if not shown in detail in the remaining figures or description.

Figure 9:
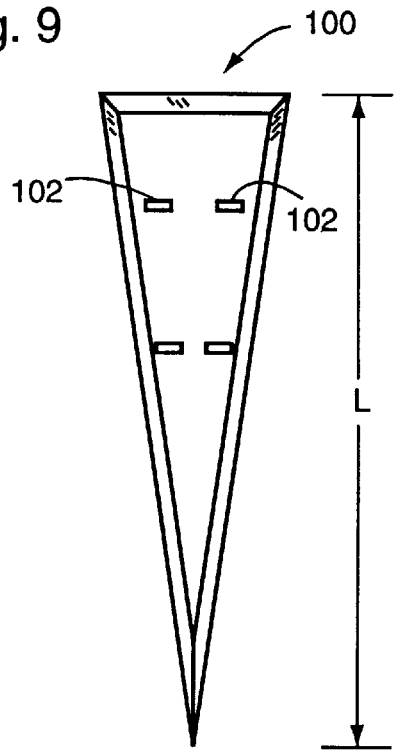
FIG. 9 is a back view of an alternative embodiment of the sound absorber.
Figure 10:
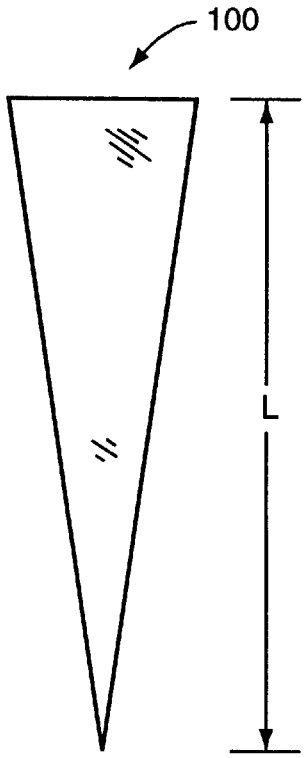
FIG. 10 is a front view of the alternative embodiment of the sound absorber as shown in FIG. 9.

FIGS. 9 and 10 show first alternative embodiment 100. This sound absorber 100 has all the features as shown in FIGS. 1–8. However, as depicted in FIGS. 9 and 10, the length L of the sound absorber 100 is greater than that shown in the sound absorber 34. The length L may vary as is necessary for any given room. However, the sound absorber 100 cannot be greater in length L than the distance between the floor and the ceiling of a standard room for the sound absorber 100 to fit in the room. However, the length L can vary to a great extent. If the length L is sufficiently great, light attaching brackets 102 may also be added. A light attaching bracket 102 with an attached light (not shown) will give a more aesthetic appearance and will backlight the sound absorber 100 but perform no function as to the sound absorption function of sound absorber 100. The bracket 102 and extended length L are the only differences between the sound absorber 34 and the sound absorber 100.

Figure 11:
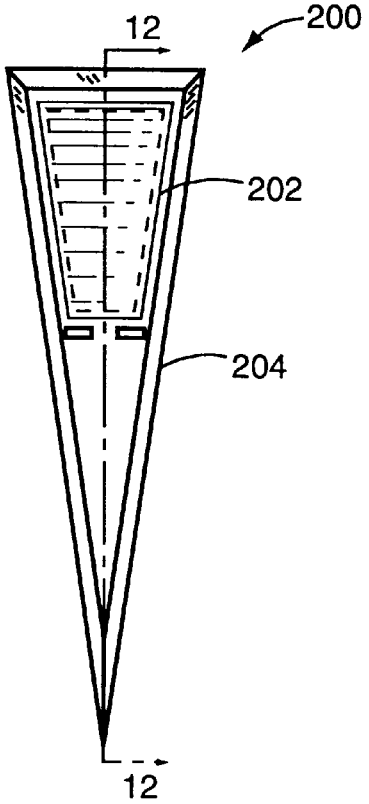
FIG. 11 is a back view of a second alternative embodiment of the invention.
Figure 12:
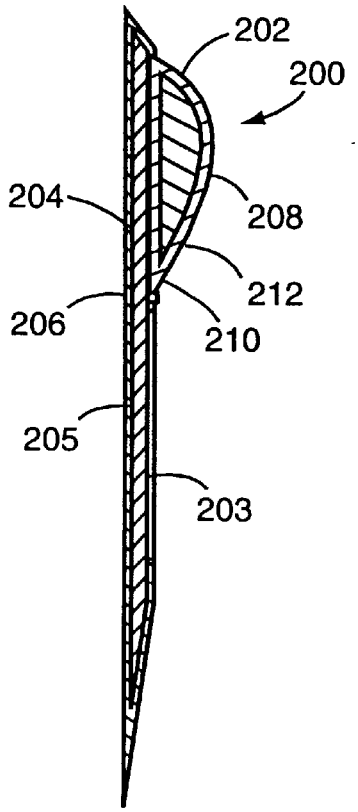
FIG. 12 is a side view of the second alternative embodiment of the invention as shown in FIG. 11.
Figure 13:
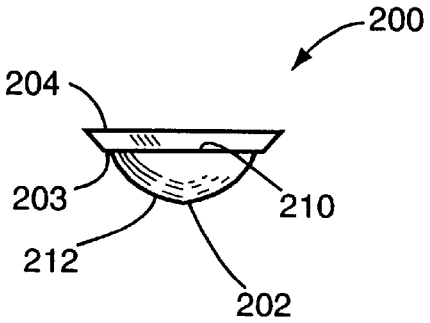
FIG. 13 is a top view of the second alternative embodiment of the invention as shown in FIG. 11.

FIGS. 11–13 show a second alternative embodiment of the sound absorber 200. Sound absorber 200 has the same features as sound absorber 34 shown in FIGS. 1–8. The primary difference between sound absorber 200 and sound absorber 34 is that sound absorber 200 includes a fiberglass pad 202 attached to the back face 203 of fiberglass panel 204. Front face 205 of fiberglass panel 204 is covered with a porous material 206. Porous material 206 may be a woven polyester. Fiberglass pad 202 may be covered by a second porous material 208. Second porous material 208 may be the same porous material as porous material 206 and porous material 208 is also preferably a woven polyester. The fiberglass pad 202 may have any density as long as it does not add drastically to the weight of sound absorber 200. However, it preferably has a density between about 1 pound per cubic foot and about 3 pounds per cubic foot. Fiberglass pad may be attached to the back face 203 of fiberglass panel 204 through any of a variety of conventional ways including but not limited to an adhesive, velcro, tacking, stapling or the like. The fiberglass pad 202 has a flat face 210 and a curved face 212. The flat face 210 is attached to the back face 203 of the fiberglass panel 200. The curved face 212 extends away from the back face 203 of the fiberglass panel 200. As is best seen in FIG. 11, the flat face 210 of the fiberglass pad 202 is generally trapezoidal.

Figure 23:
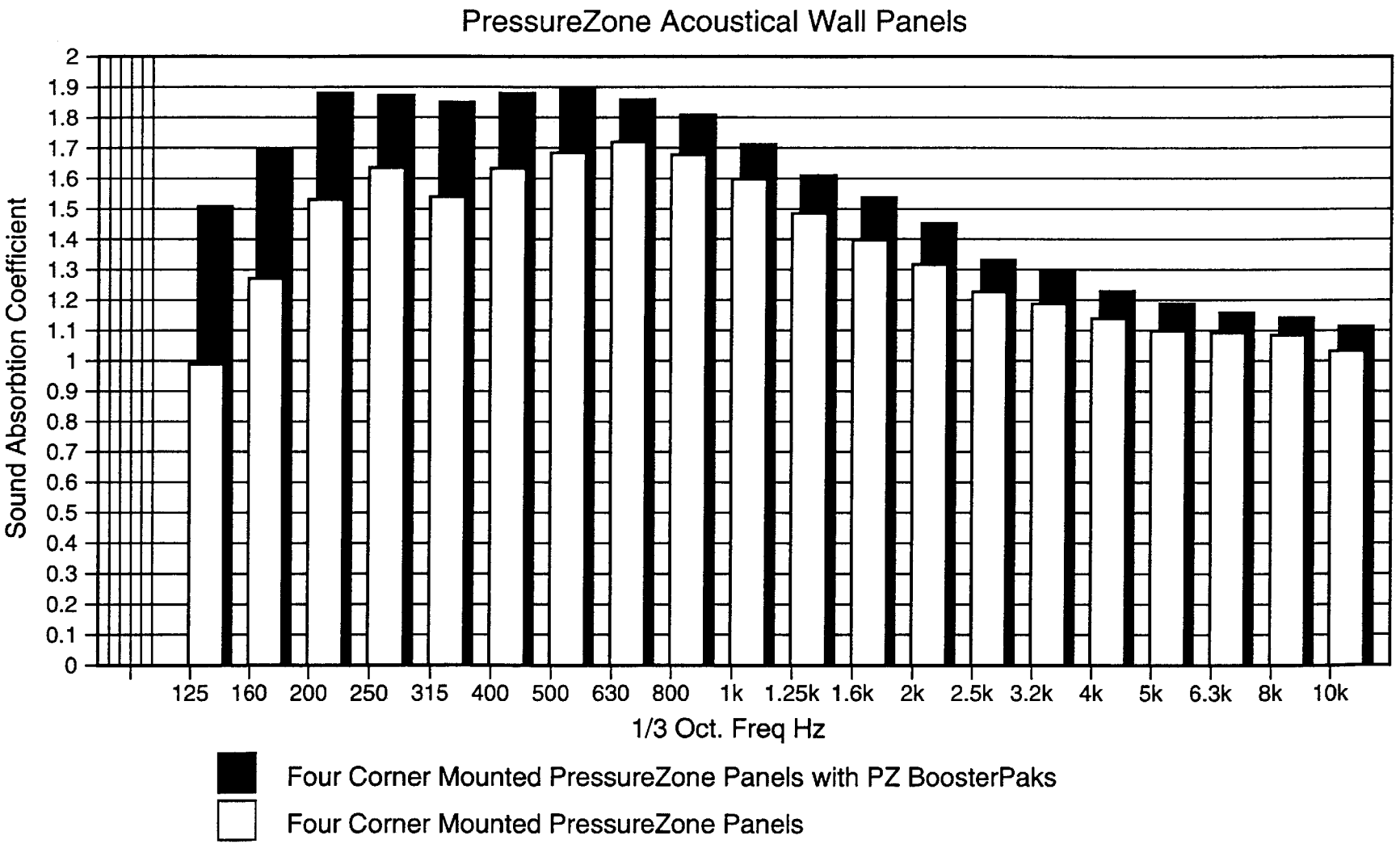
FIG. 23 is a chart showing the sound absorption characteristics of the second alternative embodiment of the invention with and without the fiberglass pad.

The performance of the sound absorber 34 differs from that of the sound absorber 200 with the fiberglass pad 202. The chart labeled as FIG. 23 shows a comparison of a sound absorber 200 with and without the fiberglass pad 202. It is noted that the use of the fiberglass pad 202 substantially increases performance, particularly at lower frequencies.

Figure 14:
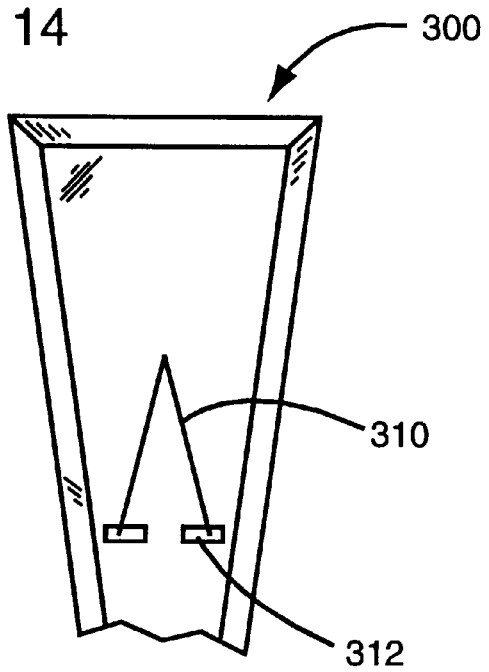
FIG. 14 is the back view of the first embodiment of the invention partially cut away and including a wire.
Figure 15:
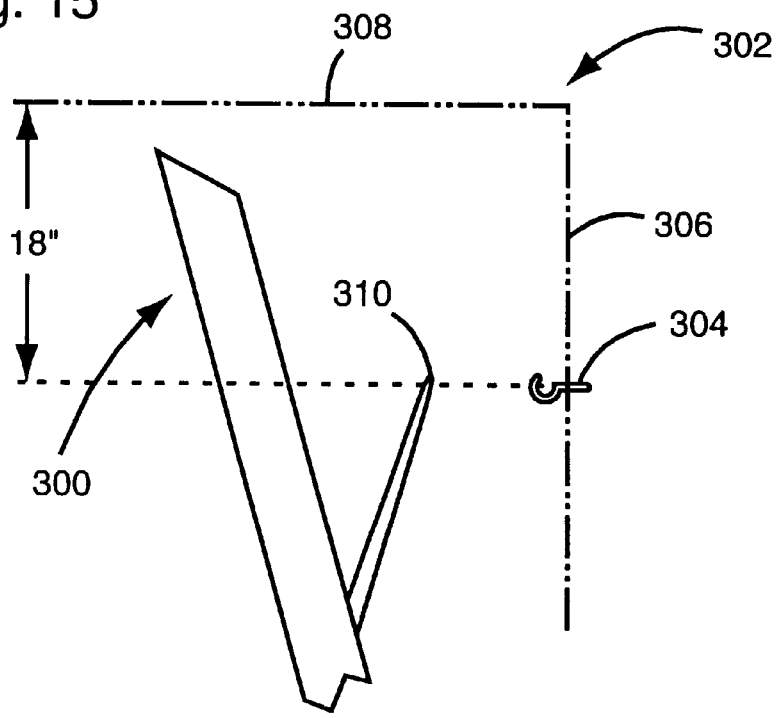
FIG. 15 is a perspective view of the sound absorber according to the invention being attached to the wall.
Figure 17:
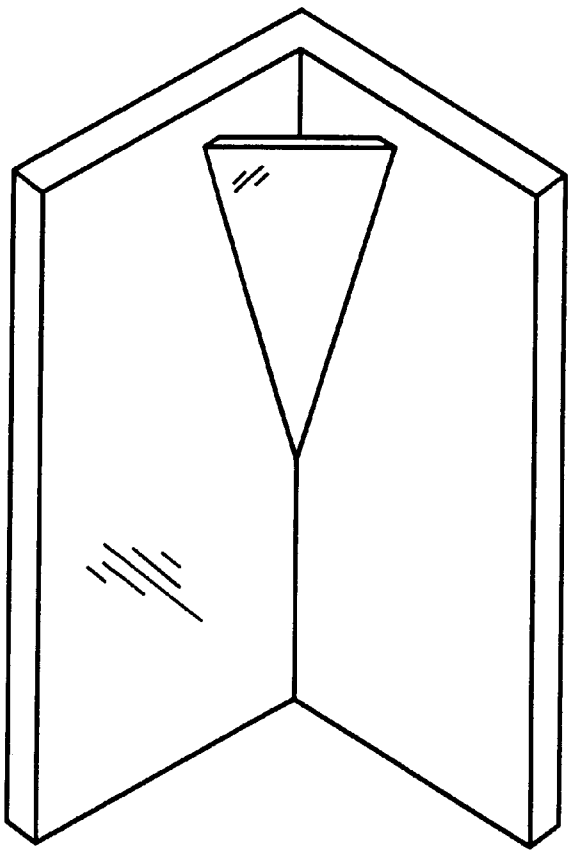
FIG. 17 is a perspective view of the invention hanging on a wall.
Figure 16:
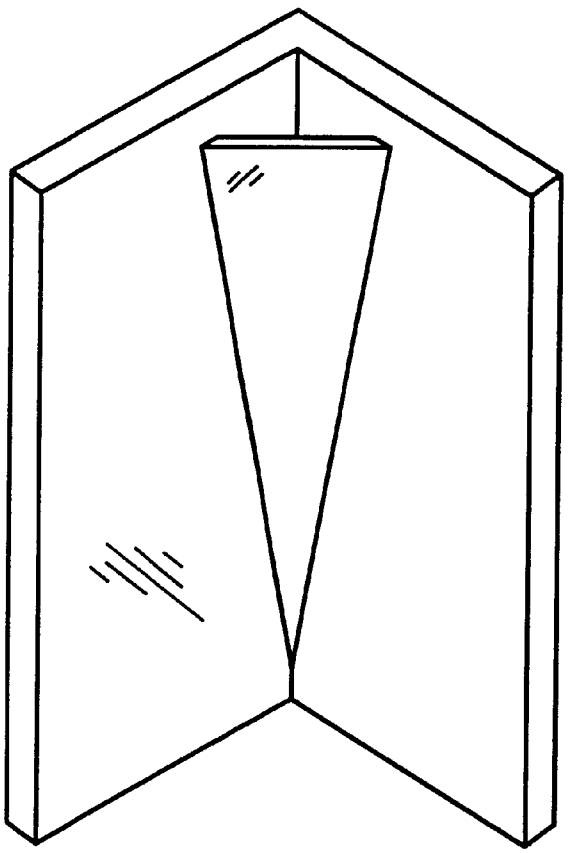
FIG. 16 is a sound absorber according to the present invention hanging on a wall.

Turning now to FIGS. 14 and 15, the preferred structure for attaching sound absorber 300 in a room 302 is shown. The sound absorber 300 may be any of the previously described embodiments, as all are attached to room a 302 in a similar way. New numbers will be given to each part of the sound absorber 300, but it will be understood that the element described is the same as that previously described.

A hook 304 is screwed into a wall 306 of the room 302. The hook 304 is preferably screwed into the wall 306 about 18 inches from the ceiling 308. A wire 310 is attached to one or more brackets 312 attached to the triangular fiberglass panel 314. The wire 310 is then placed on the hook 304 which is capable of receiving the wire 310. It is obvious to one of ordinary skill in the art that another type of attaching mechanism can be used instead of the hook 304, such as a standard picture hanger, a nail, or the like, as long as it is sufficiently strong to support the weight of the sound absorber 300.

Figure 18:
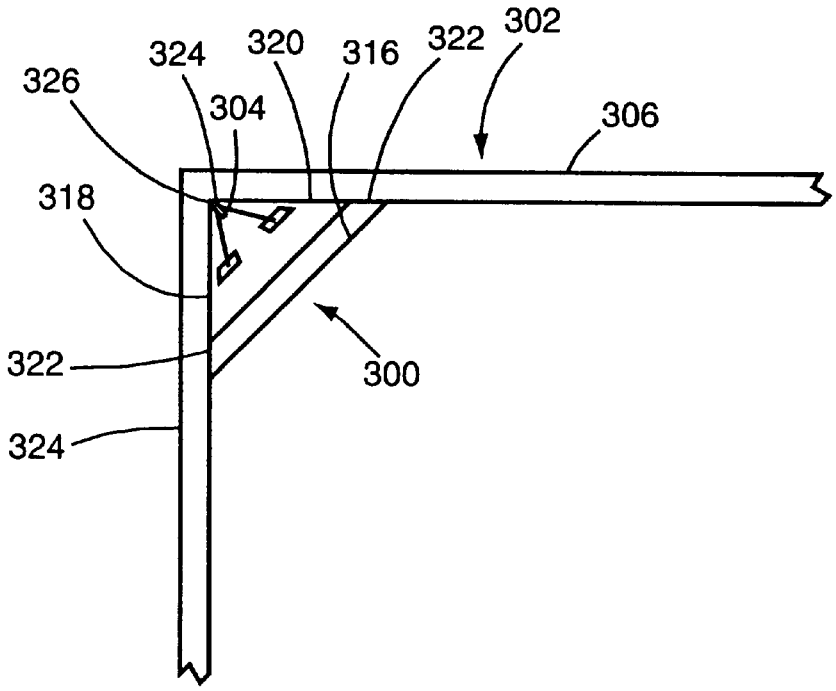
FIG. 18 is a top view of a corner of a room including a sound absorber according to the invention.
Figure 19:
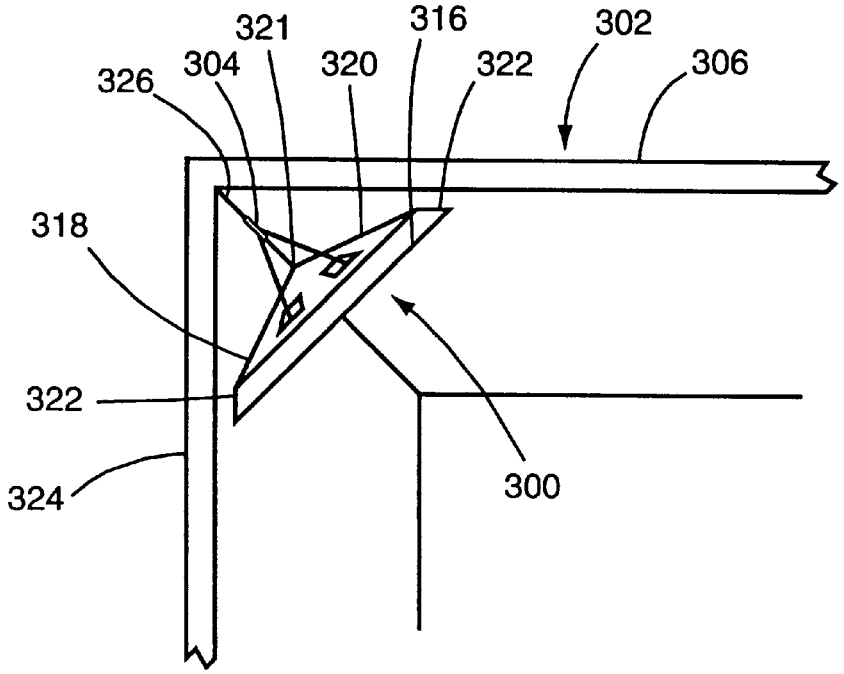
FIG. 19 is a perspective view of a corner of a room including a sound absorber according to the invention.

Turning now to FIGS. 18 and 19, the preferred location for the sound absorber 300 in a room 302 is shown. As in sound absorber 34, the sound absorber 300 has a top edge 316 and two side edges 318,320 converging at a bottom point 321. Each side edge 318,320 includes a bevel 322. Each edge 318, 320 rests against a respective wall 324, 306. The bottom point 321 rests against the corner 326 defined by the juncture of the walls 324,306. The preferred location for attaching the hook 304 is in the corner 326. It is understood that if the hook 304 is attached in the corner 326 that it is attached to both wall 324 and wall 306. The hook may be attached to only one wall 324 or 306, alternatively.

Figure 20:
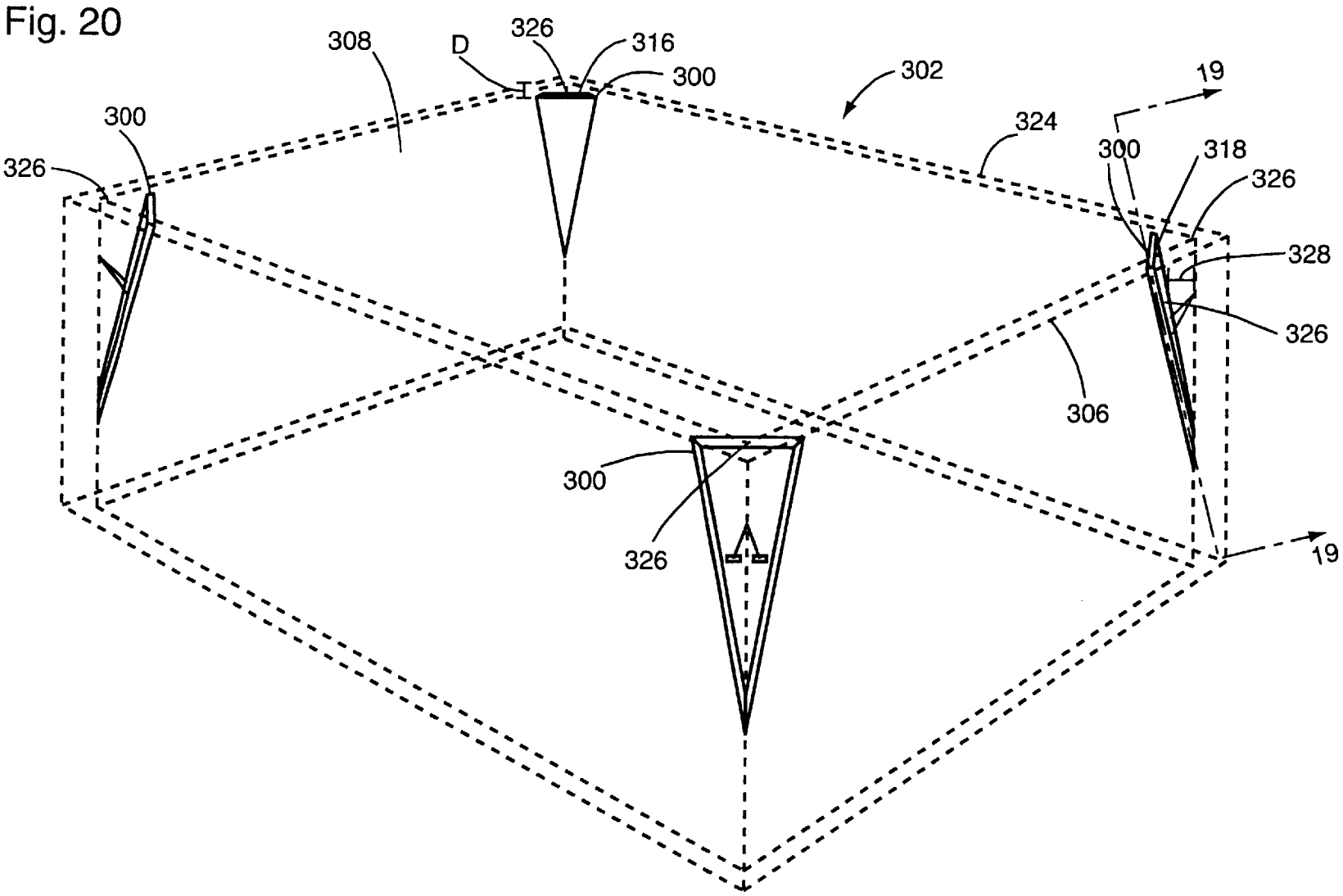
FIG. 20 is a perspective view of a room which includes a sound absorber according to the invention.
Figure 21:
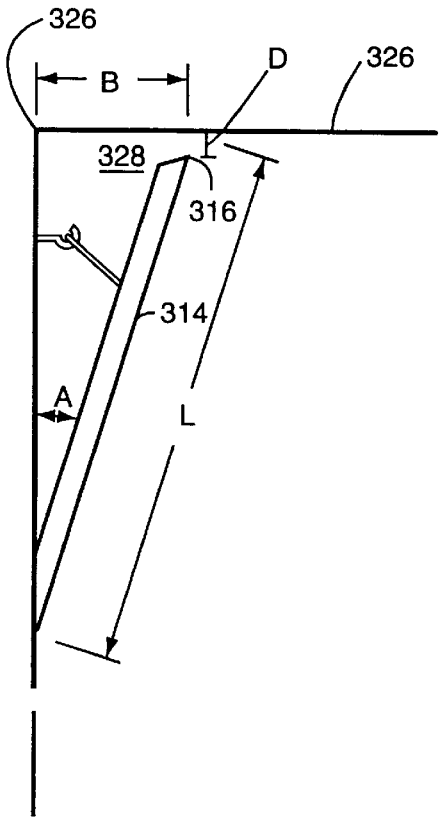
FIG. 21 is a cross-sectional view of a room in accordance with the invention taken along line 21—21 of FIG. 20.
Figure 22:
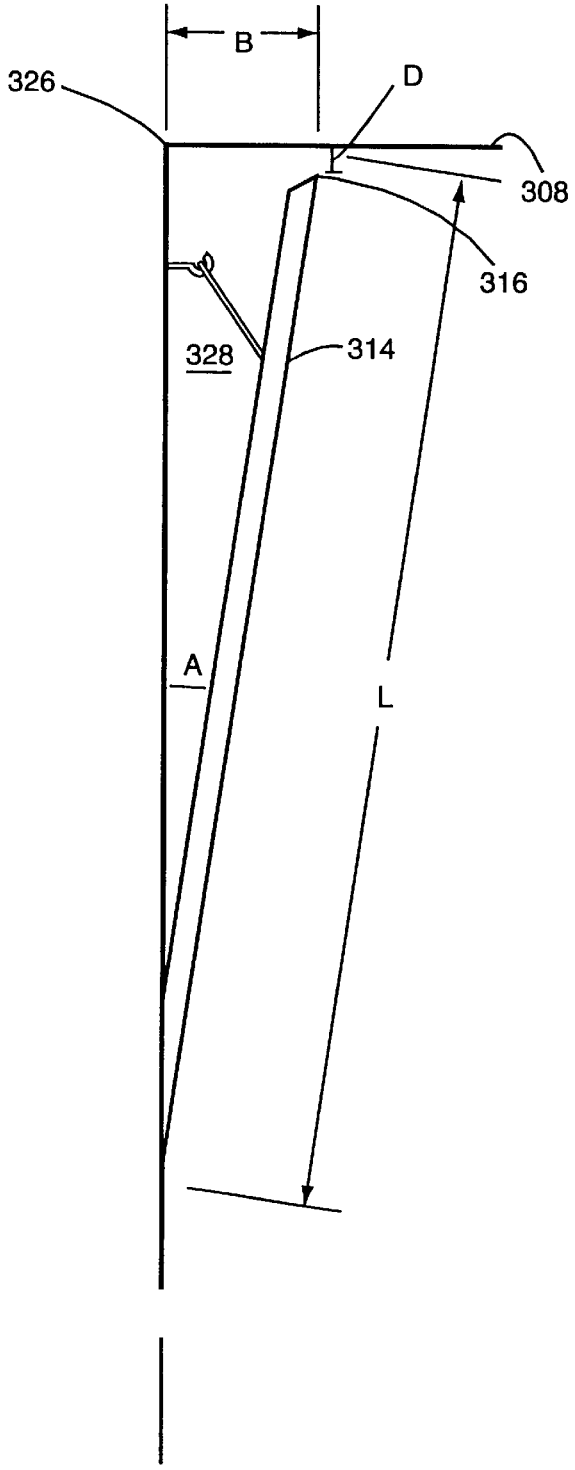
FIG. 22 is a cross-sectional view of an alternative embodiment of the invention in the same position as the sound absorber shown in FIG. 20.

FIG. 20 illustrates the use of multiple sound absorbers 300 in each corner 326 of a room 302. As shown, each triangular panel 314 is hung such that the top edge 316 of the sound absorber 300 is a distance D from the ceiling 308. Distance D is preferably between about two inches and about four inches. While this is specifically labelled only for one sound absorber 300 in one corner 326, it is true for each sound absorber 300 in each corner 326. The existence of a certain distance D between the top edge 316 and the ceiling 308 is important, because it is otherwise impossible to hang a sound absorber 300 in a room 302.

It is also important that each edge 318,320 rests against a wall 324,306 to properly define an air space 328 between the panel 314 and the corner 326. The air space 328 behind the panel 314 is important in order to properly absorb sound. The existence of the distance D between the top edge 316 and the ceiling 308, as long as it is not much larger than the range given earlier, does not substantially affect the performance of sound absorber 300 as long as the other edges 318,320 each rest against a wall 324,306. The use of the 45 degree bevel mentioned earlier assists in ensuring that each edge 318,320 properly rests against a wall 324,306.

Turning now to FIGS. 19 and 20, the air space 328 is clearly shown. Air space 328 must be sufficiently large so as to allow the sound to be properly absorbed. The top edge 316, is a distance D from the ceiling 308. The top edge 316 should also be a distance B from the corner 326. The distance B should be about twelve inches. For a given length L of the triangular panel 314, the angle A between the panel 314 and the corner 326 will vary. For a length L of about eighty-four inches, the angle A is about 8 degrees, as the performance of the sound absorber 300 falls off if the angle A is any smaller.

While certain preferred embodiments of the present invention have been disclosed in detail, it is to be understood that various modifications may be adopted without departing from the spirit of the invention or scope of the following claims.

We claim:

1. A sound absorber, comprising a panel formed of fiberglass, comprising:

(a) a triangular front face having a top edge and two side edges converging at a bottom point; and (b) a triangular back face having a smaller surface area than said front face and joined to said front face by a beveled edge surface.

2. The sound absorber according to claim 1, wherein said front face is covered by a porous material.

3. The sound absorber according to claim 2, wherein said porous material is a polyester fabric.

4. The sound absorber according to claim 3, wherein said polyester fabric is woven.

5. The sound absorber according to claim 1, wherein each said edge is hardened.

6. The sound absorber according to claim 5, wherein each said edge is hardened with a self-curing edge hardener.

7. The sound absorber according to claim 1, wherein said fiberglass has a density less than about 15 pounds per cubic foot.

8. The sound absorber according to claim 7, wherein said fiberglass has a density between about 4 pounds per cubic foot and about 8 pounds per cubic foot.

9. The sound absorber according to claim 8, wherein said fiberglass has a density of about 6 pounds per cubic foot.

10. The sound absorber according to claim 1, further comprising at least one bracket attached to said back face.

11. The sound absorber according to claim 10, further comprising a wire attached to said at least one bracket.

12. The sound absorber according to claim 11, further comprising a hook for receiving said wire and attaching said panel to a wall.

13. The sound absorber according to claim 1, wherein said back face is joined to said front face by a plurality of beveled edge surfaces.

14. The room according to claim 13, wherein said top edge of said panel is spaced a distance from said ceiling.

15. The room according to claim 13 wherein the juncture of two of said walls define a corner and said top edge is spaced a distance from said corner.

16. The room according to claim 15, wherein said bottom point rests against said corner.

17. The room according to claim 14, wherein the angle between said corner and said triangular panel is at least 8 degrees.

18. A room, comprising, (a) at least two walls;

(b) a ceiling; and (c) a sound absorber, comprising a panel formed of fiberglass, comprising:

(1) a triangular front face having a top edge and two side edges converging at a bottom point; and (2) a triangular back face having a smaller surface area than said front face and joined to said front face by two beveled edge surfaces, each beveled edge surface resting against one said wall.

19. A process for making a sound absorber, comprising:

providing a fiberglass panel of generally triangular shape and having a front face, a back face, a top edge, and two side edges converging at a bottom point;

applying an edge hardener to each said edge of said panel;

curing said edge hardener;

attaching at least one bracket to said back face of said panel; and attaching a wire to said bracket.

20. The process for making a sound absorber according to claim 19, further comprising attaching a second bracket to said back face of said panel and wherein said wire attaching step comprises attaching said wire to each said bracket.

21. The process for making a sound absorber according to claim 19, further comprising applying a hardener around said at least one bracket.

22. The process for making a sound absorber according to claim 21, further comprising applying a hardener around each said bracket.

23. The process for making a sound absorber according to claim 19, further comprising attaching a fiberglass pad to said back face of said panel.

24. The process for making a sound absorber according to claim 19, further comprising covering said front face with a porous material.

* * * * *